United States Patent [19]

Andreadakis

[11] Patent Number: 4,464,135

[45] Date of Patent: Aug. 7, 1984

[54] METHOD OF MAKING A DISPLAY PANEL

[75] Inventor: Nicholas C. Andreadakis, Branchburg, N.J.

[73] Assignee: Burroughs Corporation, Detroit, Mich.

[21] Appl. No.: 443,583

[22] Filed: Nov. 22, 1982 (Under 37 CFR 1.47)

[51] Int. Cl.[3] ..... H01J 9/02

[52] U.S. Cl. ..... 445/25

[58] Field of Search ..... 445/24, 25, 47

[56] References Cited

U.S. PATENT DOCUMENTS

| | | | |
|---|---|---|---|
| 2,933,648 | 4/1960 | Bentley | 445/25 |
| 3,715,785 | 2/1973 | Brown et al. | 445/24 |
| 3,776,613 | 12/1973 | Van Esdonk et al. | 445/24 |
| 4,108,521 | 8/1978 | Wicher, Jr. | 445/25 |

*Primary Examiner*—Kenneth J. Ramsey
*Assistant Examiner*—Kurt Rowan
*Attorney, Agent, or Firm*—Kevin R. Peterson; Edmund M. Chung; Robert A. Green

[57] ABSTRACT

A method of making a display panel comprising the steps of providing a glass base plate with an array of slots and securing an anode electrode in each slot; forming parallel depressions in one surface of a thin sheet of metal, and then securing it to the top surface of the base plate, with the unetched surface up and the depressions down, and then removing the material of the unetched surface of the metal sheet down to the depressions to form separate strips of metal as cathodes, on the top surface of the base plate; and finally assembling the other electrodes and parts of the panel with the base plate carrying the anode and cathode electrodes.

3 Claims, 7 Drawing Figures

METHOD OF MAKING A DISPLAY PANEL

BACKGROUND OF THE INVENTION

A new type of display panel which is described in copending application Ser. No. 051,313, filed June 22, 1979, of George E. Holz and James A. Ogle, now U.S. Pat. No. 4,386,348, comprises a gas-filled envelope including a layer of D.C. scan/address cells and a layer of quasi A.C. display cells. These cells are formed by a plurality of layers of electrodes which must be assembled in proper alignment to achieve proper operation of the panel. The present invention relates to an improved method of preparing the panel.

DESCRIPTION OF THE INVENTION

Figure 1:
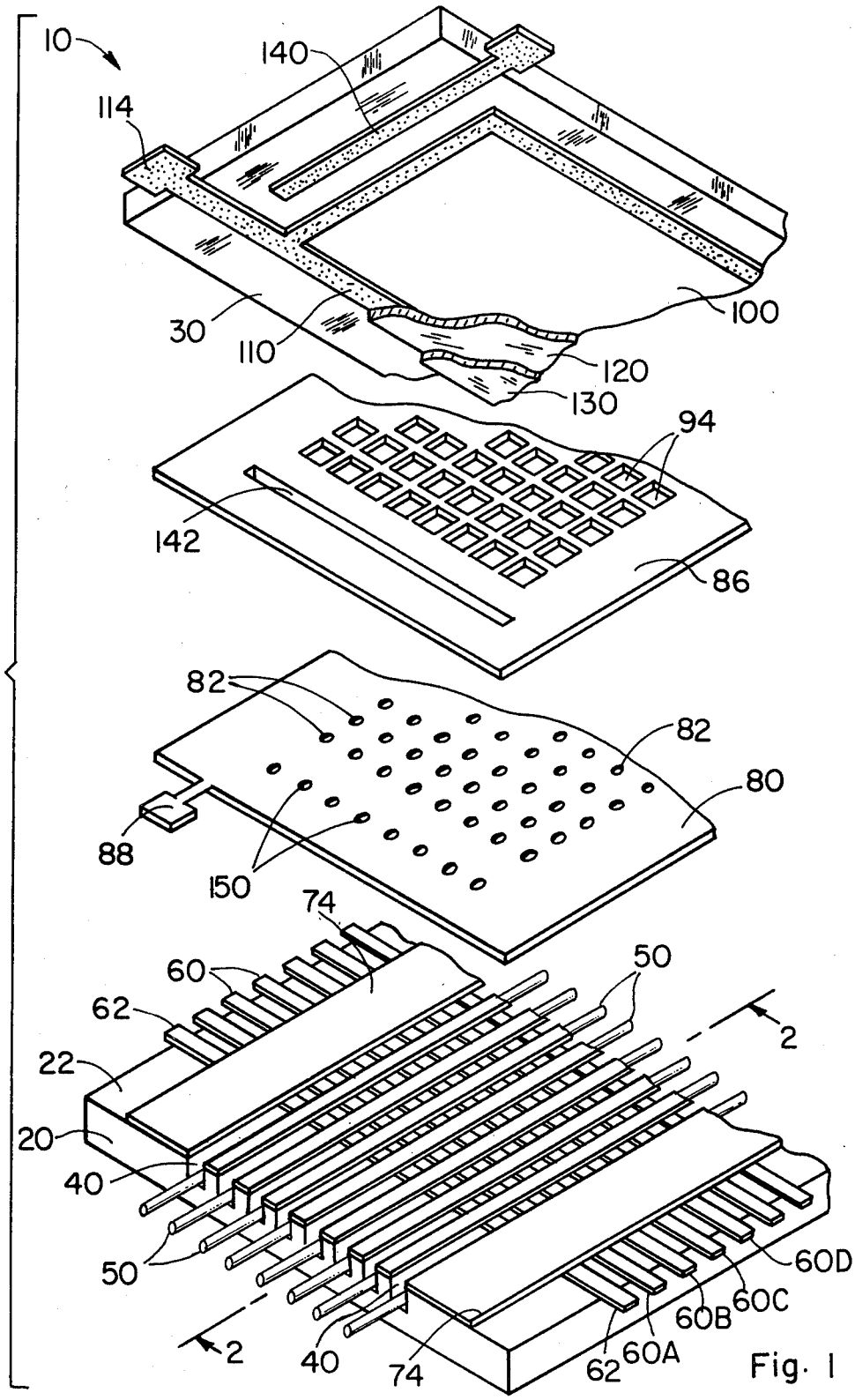
FIG. 1 is a perspective exploded view of a display panel prepared according to the invention.

The display panel 10 described herein and in application Ser. No. 051,313 comprises a gas-filled envelope made up of an insulating base plate 20 and a glass face plate 30, which is shown tilted up in FIG. 1 to present a view of its inner surface. These plates are hermetically sealed together along their aligned perimeters to provide an envelope which encloses the various gas-filled cells and operating electrodes of the panel. The base plate has a top surface 22 in which a plurality of deep parallel row slots 40 are formed and in each of which a scan/address wire anode electrode 50 is seated and secured.

Figure 2:
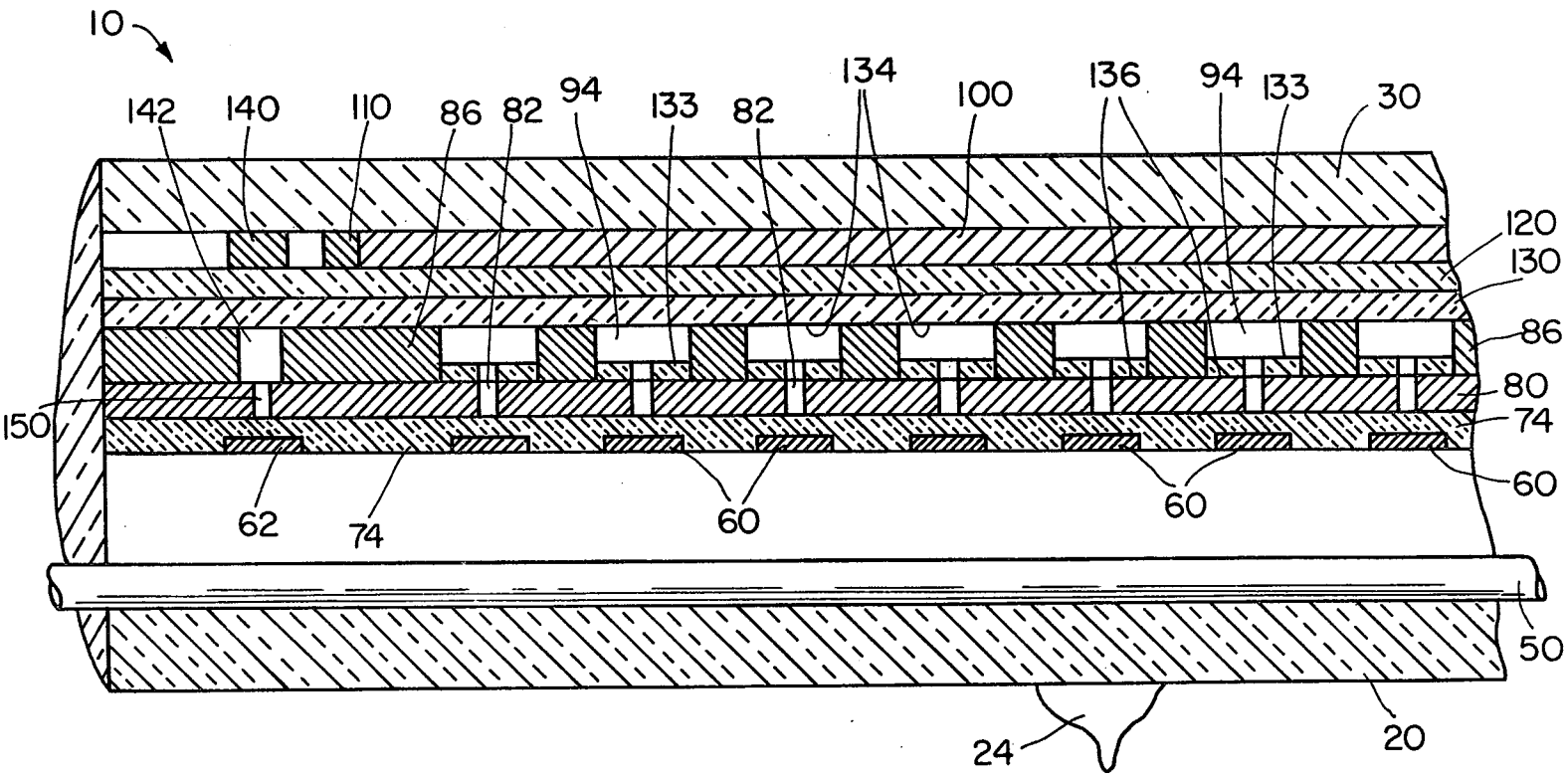
FIG. 2 is a sectional view through the panel of FIG. 1 along lines 2—2, with the panel shown assembled.

A plurality of flat strip scan cathode electrodes 60 are seated on the top surface of the base plate. The scan cathodes 60 are disposed vertically so that they are transverse to the scan anodes 50, and each crossing of a scan cathode 60 and a scan anode 50 defines a scanning cell 72 (FIG. 2). These cells form a matrix of scanning cells which are arrayed in rows and columns.

The scan cathodes 60A, B, C, etc., form a series of cathodes which can be energized serially in a scanning cycle, with cathode 60A being the first cathode energized in the scanning cycle. A cathode 62 adjacent to but ahead of the first cathode 60A is a reset cathode 62 which is energized first in a scanning cycle and provides excited particles for cathode 60A. Where the reset cathode 62 crosses each scan anode 50, a reset cell is formed, and the crossing of all of the scan anodes by the reset cathode provides a column of reset cells. These reset cells are turned on at the beginning of each scanning cycle, and they expedite the turn-on of the first column of scanning cells associated with cathode 60A.

The panel 10 includes a keep-alive arrangement which is described below and in U.S. Pat. No. 4,329,616, dated May 11, 1982, of George E. Holz and James A. Ogle, and incorporated herein by reference.

In the panel 10, it is desirable that the cathodes 60 be spaced uniformly from an electrode plate 80 disposed above the cathodes so that a thin slotted insulating sheet 74 is seated on the top surface of the base plate 20. The strips of sheet 74 lie across the cathodes 60.

The portions of the panel described up to this point comprise the base plate assembly. This is the D.C. portion and the scanning and addressing portion of the panel 10 in which the electrodes are in contact with the gas in the panel.

Adjacent to the base plate assembly is the second portion of the panel which is a quasi A.C. assembly; that is, it includes electrodes which are insulated from the gas in the panel, and electrodes which are in contact with the gas. This portion of the panel includes an electrode in the form of a thin metal plate 80 having an array of rows and columns of relatively small apertures 82, each overlying one of the scanning cells 72. The plate 80 is positioned close to cathodes 60 and may be seated on insulating sheet or layer 74, if this is provided, or directly on the top surface of the base plate 20. Plate 80 is known as a priming plate.

Adjacent to plate 80, and preferably in contact with the upper surface thereof, is an apertured plate or sheet 86 having rows and columns of apertures 94 which are larger than apertures 82. The apertures 94 comprise the display cells of panel 10. The sheet 86 may be of insulating material, or it may be of metal, and, if it is of metal, plates 80 and 86 may be made in one piece, if desired and if feasible. Plate 80 is provided with a tab 88, by which electrical circuit connection can be made thereto.

The quasi A.C. assembly also includes a face plate assembly which includes a single large-area transparent conductive electrode 100 on the inner surface of the plate 30. A narrow conductor 110 outlines and reinforces the electrode layer 100 to increase its conductivity, if necessary. The conductor 110 includes a contact tab 114, to which external connection can be made. The large-area electrode 100 is of sufficient area to overlie the entire array of display cells 94 in plate 86. An insulating coating 120 of glass or the like covers electrode 100.

Under some circumstances, it is desirable to coat the glass layer 120 with a low work function refractory layer 130 of magnesium oxide, thorium oxide, or the like.

In panel 10, the apertures 94 in plate 86 comprise display cells, and, as can be seen in FIG. 2, each display cell has one end wall 134 formed by a portion of insulating layer 130, and an opposite end wall 136 formed by a portion of the top surface of plate 80. To provide cell uniformity and to minimize sputtering, a coating of the material of layer 130 should also be provided on the base or lower wall 136 of each display cell 94, such as the layer 133 shown in FIG. 2.

At the present time, it appears that optimum operation of the panel is achieved if the apertures or cells 94 are unsymmetrical in that insulating layers 120 and 130 together have a thickness greater than layer 133. Indeed, layer 133 may even be thinner than layer 130. Thus, the lower end wall 136 of each cell 94 will have a very high capacitance coupling to the cell, and layer 133 will consequently tend to form only a minimal wall charge in the operation described below. In one mode of construction, both layer 130 and layer 133 may be formed by an evaporation process, and layer 133 may be so thin that it is not completely continuous, which is a desirable quality. In any case, however, the character of this wall of the cell is affected by the aperture 82 in the metal plate 80.

The gas filling in panel 10 is preferably a Penning gas mixture of, for example, neon and a small percentage of xenon, at a pressure of about 400 Torr. When the panel has been constructed and evacuated, the gas filling is introduced through a tubulation 24 secured to base plate 20 (FIG. 2), or a non-tubulated construction can be employed.

The keep-alive arrangement, in panel 10 includes an A.C. electrode 140 in the form of a line-like conductive film or layer of opaque metal, such as silver, provided on the inner surface of the face plate 30 adjacent to one edge of the transparent conductive electrode 100. The A.C. keep-alive electrode 140 is positioned so that, in the completed panel, it overlies the column of reset cells and reset cathode 62, to which it supplies excited particles. The A.C. keep-alive electrode 140 is covered by the insulating layers 120 and 130. Plate 86 is provided with a slot 142, and plate 80 is provided with a column of holes 150, both of which lie beneath and are aligned with the A.C. electrode 140 so that, in effect, the electrode 140, slot 142 and holes 150 form a sandwich. The slot 142 in the plate 86 is narrower than the opaque A.C. electrode 140 so that a viewer, looking through face plate 30, cannot seen any glow which is present in slot 142 and holes 150. Electrode 140 operates with plate 80 to produce glow discharge between them and produce excited particles in slot 142 and holes 150. These excited particles are available to the reset cathode 62 and assist the firing of the column of reset cells.

Systems for operating panel 10 are described in application Ser. No. 051,313 and in U.S. Pat. No. 4,315,259, dated Feb. 9, 1982, of Joseph E. McKee and James Y. Lee, which is also incorporated herein by reference.

Figure 3:
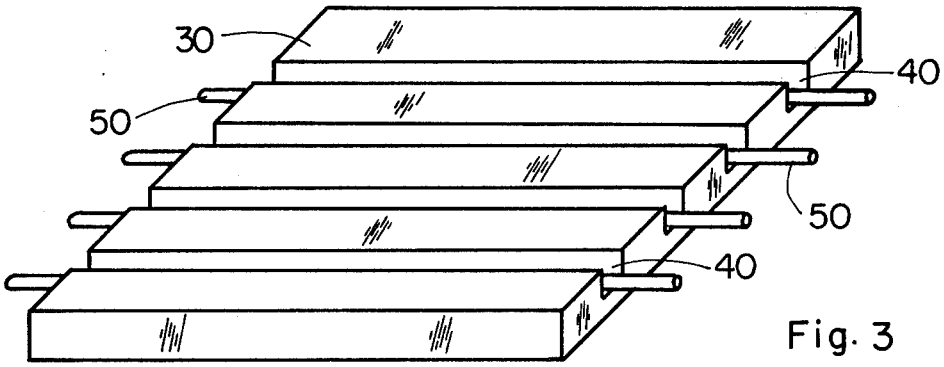
FIG. 3 is a perspective view of the base plate of the panel of FIG. 1 at one stage in the preparation of the panel.
Figure 4:
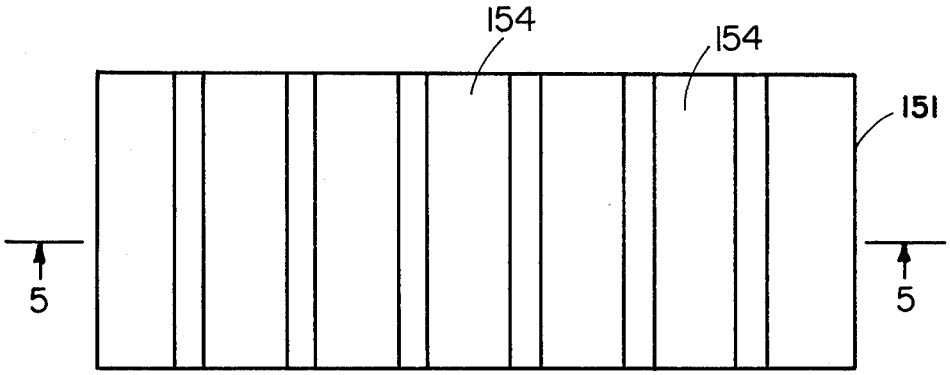
FIG. 4 is a plan view of a cathode structure used in the panel at one stage in the processing.
Figure 5:
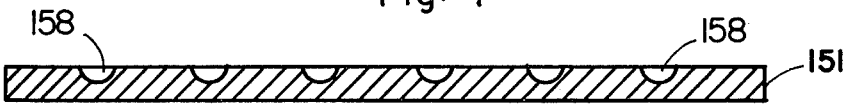
FIG. 5 is a sectional view along the lines 5—5 in FIG. 4.
Figure 6:
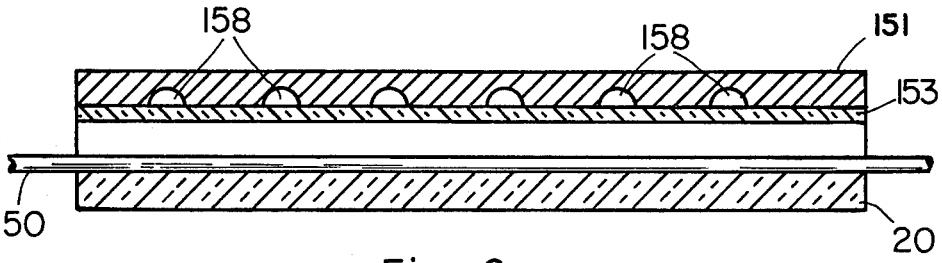
FIG. 6 is a sectional view of the pieces of FIGS. 3 and 5 at a stage in their processing.
Figure 7:
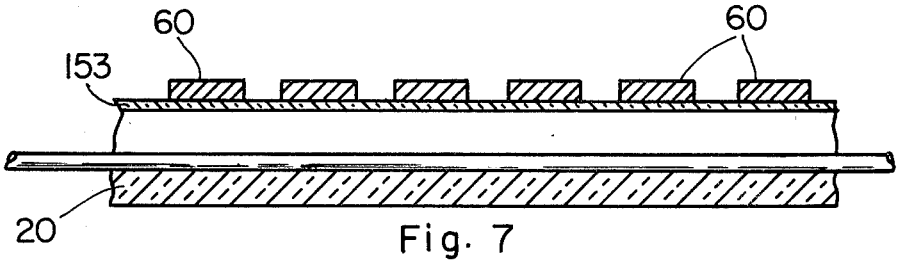
FIG. 7 is a sectional view of a portion of the assembly of FIG. 6 at a later stage in the processing thereof.

According to the method of the invention for preparing panel 10, referring to FIGS. 3 to 5, the glass base plate 30 is provided and slots 40 are formed therein in any suitable manner. Anode wire 50 are seated in the slots and secured in place, for example, by means of a glass frit. Next, (FIG. 4) a metal sheet 151, of nickel or any other material which can generate cathode glow in an ionizable gas, is prepared by being coated on both surfaces with a layer of acid resist material such as positive Shipley AZ111 in a pattern of stripes 154, and the sheet is etched with ferric chloride to partially etch away the metal between the stripes 154 to leave depressions 158 (FIG. 5). All of the acid resist is then removed. Of course, other suitable resists and etchants may be used.

A layer 153 of a seal material, such as a glass frit, is provided on the top surface of the base plate, for example, by a screening operation. The layer 153 of glass frit covers the portion of the base plate on which the cathode sheet 151 is placed with the depressions 158 down. The assembly is heated to melt the glass frit and to seal plate 151 to the top surface of the base plate. After the metal cathode sheet 151 has been secured in place, the etching solution is applied to the entire upper surface of the sheet, and the sheet is etched down to meet the depressions 158 whereby individual cathode strips 60 remain on the top surface of the base plate.

The other portions of the panel 10 shown in FIG. 1 and described above are then assembled with the base plate prepared as described, and the parts are hermetically sealed together, and the assembly is baked out and otherwise processed as required, filled with the desired gas filling, and sealed off. The panel is now ready for aging and any other required processing operations.

What is claimed is:

1. The method of making a display panel comprising the steps of preparing a base plate having a top surface and an array of slots in said top surface and first electrodes seated in said slots, providing a thin sheet of metal, removing portions of said body of said sheet of metal in a pattern of parallel stripes, securing said sheet of metal to said top surface of said base plate with the unetched surface thereof up, removing the material of said unetched surface of said metal sheet down to said etched pattern of stripes and through said pattern to form separate strips of metal of said sheet of metal on said top surface of said base plate, said strips of metal being oriented transverse to said first electrodes, and assembling other electrodes with said base plate and a face plate and hermetically sealing said face plate to said base plate to complete the panel.

2. The method of making a display panel comprising the steps of preparing a base plate having a top surface and an array of slots in said top surface and first electrodes seated in said slots, providing a thin sheet of metal, forming a pattern of stripes on one surface of said sheet of metal, etching said pattern of stripes part way into the body of said sheet of metal, securing said sheet of metal to said top surface of said base plate with the unetched surface thereof up, etching said unetched surface of said metal sheet down to said etched pattern of stripes and through said pattern to form separate strips of metal of said sheet of metal on said top surface of said base plate, said strips of metal being oriented transverse to said first electrodes, and assembling other electrodes and a face plate with said base plate and hermetically sealing said face plate to said base plate to complete the panel.

3. The method of making a display panel comprising the steps of preparing a base plate having a top surface and an array of slots in said top surface and anode electrodes seated in said slots, providing a thin sheet of metal, removing portions of said body of said sheet of metal in a pattern of parallel stripes, securing said sheet of metal to said top surface of said base plate with the unetched surface thereof up, removing the material of said unetched surface of said metal sheet down to said etched pattern of stripes and through said pattern to form separate strips of metal of said sheet of metal on said top surface of said base plate, said strips of metal being oriented transverse to said anode electrodes and comprising cathode electrodes, providing a layer of insulating material in parallel strips on said metal strip cathode electrodes, mounting an apertured plate on said layer of insulating material, the apertures having two portions, a first small diameter portion and a larger diameter portion which comprises display cells in the panel when operated, securing a face plate to said base plate with a hermetic seal between them, said face plate carrying on its inner surface a large-area transparent conductive electrode coated with a film of glass to make the electrode an A.C. electrode which takes part in controlling the operation of said display cells, and filling the panel with an ionizable gas suitable for providing glow in the panel.

* * * * *